US011346258B1

(12) United States Patent
Nickols et al.

(10) Patent No.: US 11,346,258 B1
(45) Date of Patent: May 31, 2022

(54) MARINE ENGINES HAVING CAM PHASER

(71) Applicant: Brunswick Corporation, Mettawa, IL (US)

(72) Inventors: Thomas F. Nickols, Fond du Lac, WI (US); Daniel P. Hoffman, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/393,062

(22) Filed: Aug. 3, 2021

(51) Int. Cl.

| | |
|---|---|
| ***F01L 1/344*** | (2006.01) |
| ***F02B 61/04*** | (2006.01) |
| ***F01L 1/047*** | (2006.01) |
| *F01L 1/053* | (2006.01) |

(52) U.S. Cl.
CPC ..... *F01L 1/34406* (2013.01); *F01L 1/047* (2013.01); *F02B 61/045* (2013.01); *F01L 2001/0475* (2013.01); *F01L 2001/0537* (2013.01); *F01L 2001/34486* (2013.01)

(58) Field of Classification Search
CPC ..... F01L 1/047; F01L 2001/0475; F01L 2001/0537; F01L 1/34406; F01L 2001/34486; F02B 61/045
USPC ..... 123/90.17, 90.27, 90.31
See application file for complete search history.

(56) References Cited

U.S. PATENT DOCUMENTS

| | | | | |
|---|---|---|---|---|
| 6,167,854 | B1 * | 1/2001 | Regueiro | F01L 1/34406 123/90.31 |
| 9,228,455 | B1 * | 1/2016 | Belter | B63H 20/24 |
| 9,944,373 | B1 * | 4/2018 | Kollock | B63H 20/002 |
| 9,970,331 | B1 * | 5/2018 | Belter | F16H 7/18 |
| 9,994,294 | B1 | 6/2018 | Kim | |
| 10,280,812 | B1 | 5/2019 | Kim et al. | |
| 10,533,467 | B1 | 1/2020 | Anderson | |
| 2006/0060159 | A1 * | 3/2006 | Moretz | F01L 1/34413 123/90.15 |
| 2015/0285107 | A1 * | 10/2015 | Kim | F01L 1/462 123/90.16 |
| 2016/0032791 | A1 * | 2/2016 | Cecil | F01L 1/3442 123/90.15 |
| 2019/0003347 | A1 * | 1/2019 | Wigsten | F01L 1/3442 |

* cited by examiner

*Primary Examiner* — Jorge L Leon, Jr.
(74) *Attorney, Agent, or Firm* — Andrus Intellectual Property Law, LLP

(57) ABSTRACT

A marine engine has an intake camshaft, an exhaust camshaft, and a crankshaft. Combustion in the marine engine causes rotation of the crankshaft which in turn causes rotation of the intake camshaft and exhaust camshaft. Rotation of the intake camshaft operates intake valves for controlling inflow of air to the marine engine. Rotation of the exhaust camshaft operates exhaust valves for controlling outflow of exhaust gas from the marine engine. A cam phaser is located at least partially inside at least one of the intake camshaft and the exhaust camshaft and is configured to vary a timing of operation of at least one of the intake valves and exhaust valves.

18 Claims, 10 Drawing Sheets

MARINE ENGINES HAVING CAM PHASER

FIELD

The present disclosure relates to engines for marine drives, and more particularly to marine engines having cam phasers.

BACKGROUND

The following U.S. Patents are incorporated herein by reference:

U.S. Pat. No. 9,228,455 discloses a marine engine for an outboard motor having a bank of cylinders, an intake camshaft that operates intake valves for controlling inflow of air to the bank of cylinders, an exhaust camshaft that operates exhaust valves for controlling outflow of exhaust gas from the bank of cylinders, and a cam phaser disposed on one of the intake camshaft and exhaust camshaft. The cam phaser is connected to and adjusts a timing of operation of the other of the intake camshaft and exhaust camshaft with respect to the one of the intake camshaft and exhaust camshaft.

U.S. Pat. No. 9,944,373 discloses an outboard marine engine having a vertically aligned bank of cylinders; a camshaft that operates a plurality of valves for controlling flow of air with respect to the vertically aligned bank of cylinders, the camshaft vertically extending between a lower camshaft end and an upper camshaft end; and a cam lobe at the upper camshaft end. Rotation of the camshaft causes the cam lobe to cam open an uppermost valve in the plurality of valves. A lubricant circuit extends through the camshaft and has a lubricant outlet located at the upper camshaft end. The lubricant outlet is configured to disperse lubricant onto the uppermost valve, which is located above an uppermost cam bearing bulkhead for the upper camshaft end.

U.S. Pat. No. 9,970,331 discloses an outboard marine engine having a vertically aligned bank of cylinders; an intake camshaft that operates a plurality of intake valves for controlling inflow of air to the bank of cylinders; an exhaust camshaft that operates a plurality of exhaust valves for controlling outflow of exhaust as from the bank of cylinders; and a cam-to-cam connector that connects the intake camshaft to the exhaust camshaft such that rotation of one of the intake and exhaust camshafts causes rotation of the other of the intake and exhaust camshafts. The cam-to-cam connector is located vertically above a lowermost intake valve in the plurality of intake valves, vertically above a lowermost exhaust valve in the plurality of exhaust valves, vertically below an uppermost intake valve in the plurality of intake valves and vertically below an uppermost exhaust valve in the plurality of exhaust valves.

U.S. Pat. No. 9,994,294 discloses an outboard marine engine having a vertically-aligned bank of cylinders. An axially elongated camshaft operates a plurality of valves for controlling flow of air with respect to the vertically-aligned bank of cylinders. The camshaft vertically extends between a lower camshaft end and an upper camshaft end. A lubricant passage axially conveys lubricant through the camshaft. An air outlet is located at the upper camshaft end. A valve is configured to open and close the air outlet to thereby facilitate lubrication of the plurality of valves at startup of the outboard marine engine.

U.S. Pat. No. 10,280,812 discloses a cylinder head for a marine engine having an axially elongated camshaft, cam lobes that are axially spaced apart from each other along the camshaft, and valves that control one of a flow of intake air for combustion in the marine engine or a flow of exhaust gas from the marine engine. The cam lobes actuate the valves upon rotation of the camshaft. Each cam lobe comprises first and second cam lobe sections that are axially spaced apart from each other along the camshaft.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain embodiments, a marine engine has an intake camshaft, an exhaust camshaft, and a crankshaft. Combustion in the marine engine causes rotation of the crankshaft which in turn causes rotation of the intake camshaft and the exhaust camshaft. Rotation of the intake camshaft operates intake valves for controlling inflow of air to the marine engine. Rotation of the exhaust camshaft operates exhaust valves for controlling outflow of exhaust gas from the marine engine. A cam phaser is located at least partially inside at least one of the intake camshaft and the exhaust camshaft and is configured to vary a timing of operation of at least one of the intake valves and exhaust valves. In certain embodiments, the intake camshaft has a first camshaft portion and an opposite, second camshaft portion, and the cam phaser is located between first camshaft portion and the second camshaft portion.

Various other features, objects, and advantages of the invention will be made apparent from the following description taken together with the drawings.

BRIEF DESCRIPTION OF THE DRAWINGS

The present disclosure refers to the following drawing Figures.

DETAILED DESCRIPTION

As disclosed in the above-incorporated U.S. Pat. No. 9,228,455, it is known to provide marine engines with a cam phaser that facilitates relative rotational adjustment or "phasing" of exhaust and intake camshafts, for example in a dual overhead cam arrangement. In the embodiments disclosed in the '455 patent, the cam phaser is typically located at the lower ends of the camshafts relative to the outboard motor. A pump and a conventional proportional integral control valve or other known hydraulic control mechanism provides supply of high pressure oil to the cam phaser, which controls the rotational position of the camshafts relative to the crankshaft. This type of controlled "cam phasing" is well known in the art and is implemented to control the opening and closing of the engine valves during the combustion process, facilitating better efficiency during various engine operating conditions including low and high speed conditions. Reference is made to the '455 patent for further background information regarding known cam phasers and controllers for controlling the cam phasers.

During research and development of marine engines having cam phasers, the present inventors determined it would be desirable to provide improved phaser arrangements that take up less space in the marine drive powerhead compartment and that also better facilitate controlled phasing of the camshafts relative to the crankshaft, and isolated phasing of one of the camshafts, for example just the intake camshaft.

Figure 1:
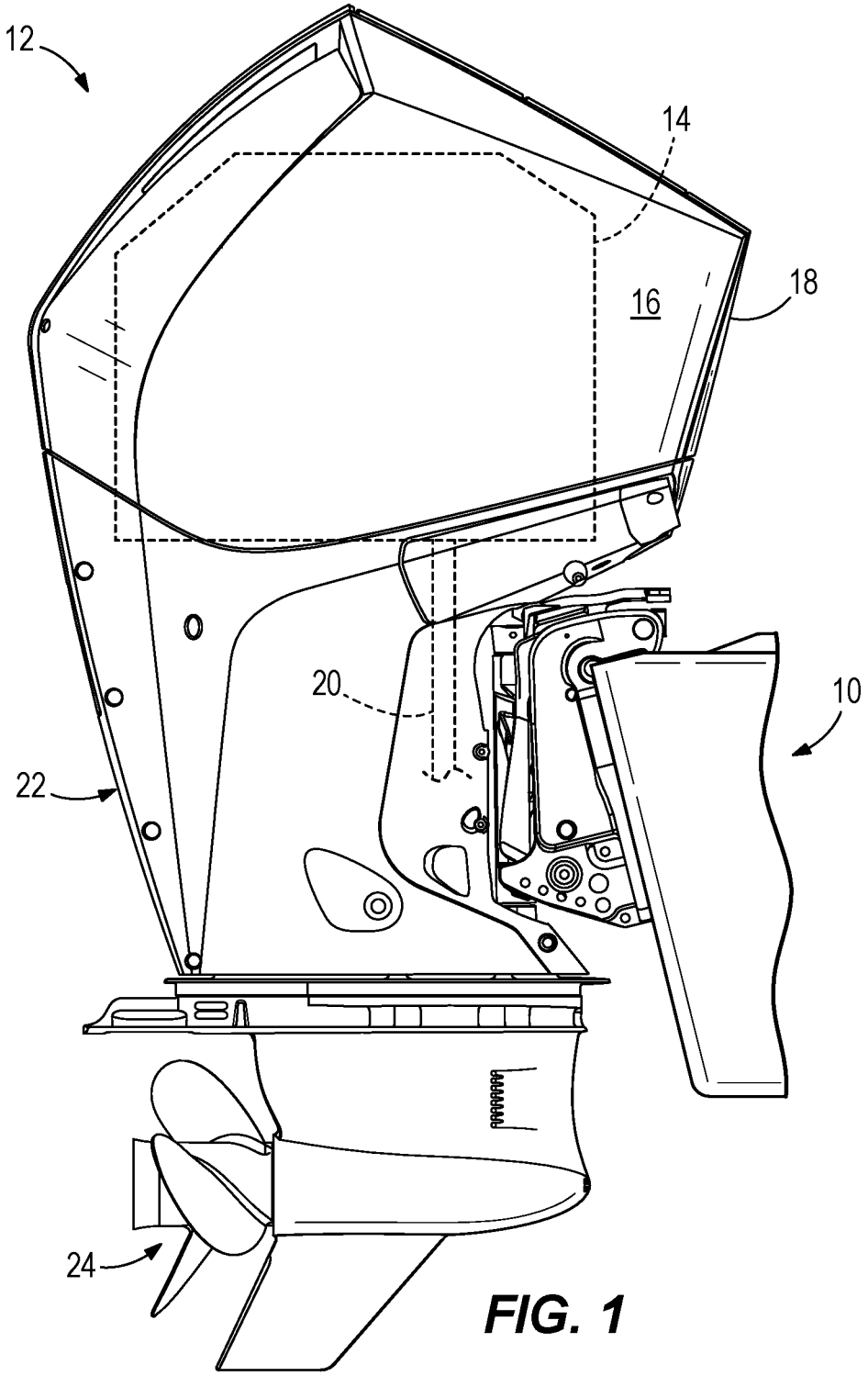
FIG. 1 is a side view of a transom of a marine vessel. A marine drive is on the transom, the marine drive having a marine engine configured according to the present disclosure.

FIG. 1 depicts the transom 10 of a marine vessel. A marine drive, which in the illustrated embodiment is an outboard motor 12, is coupled to the transom 10 and is configured to generate a thrust force for propelling the marine vessel in water. The outboard motor 12 has an internal combustion engine 14, which is located in a powerhead compartment 16 covered by a top cowl 18. Combustion of fuel in the engine 14 causes rotation of a driveshaft 20. The driveshaft 20 extends into a midsection 22 of the outboard motor 12 and has a lower end operably coupled to a propulsor, which in the illustrated embodiment includes a propeller 24. The driveshaft 20 and propeller 24 can be connected by a conventional angle gearset and/or propeller shaft and/or any other known means for operably connecting the driveshaft 20 to the propeller 24 so that rotation of the driveshaft 20 causes rotation of the propeller 24, which in turn generates the thrust force.

It should be understood that according to the present disclosure the type and configuration of marine drive can vary from what is shown and presently described. The present invention is useful in marine drives of all types, such as inboard drives and stern drives. The type and configuration of the engine can also vary from what is presently described, and for example can be part of a conventional electric or hybrid configuration. The type and configuration of the propulsor can also vary from what is shown and presently described, and for example can include more than one propeller, or any number of impellers, and/or any other conventional mechanism for generating a thrust force in water.

In one embodiment, the engine 14 has first and second banks of cylinders. The cylinders are not shown in the drawings but are well known engine components, for example disclosed in the above-incorporated patents. In the exemplary embodiment, the noted first and second banks of cylinders extend transversely from each other in a V-shape. However it should be understood that the present invention is suitable for use in other types of engine configurations, including but not limited to inline configurations. As conventional, combustion of fuel in the cylinders causes reciprocation of pistons in the cylinders, which via connecting rods causes rotation of a crankshaft 26, which in turn causes rotation of the driveshaft 20.

Figure 2:
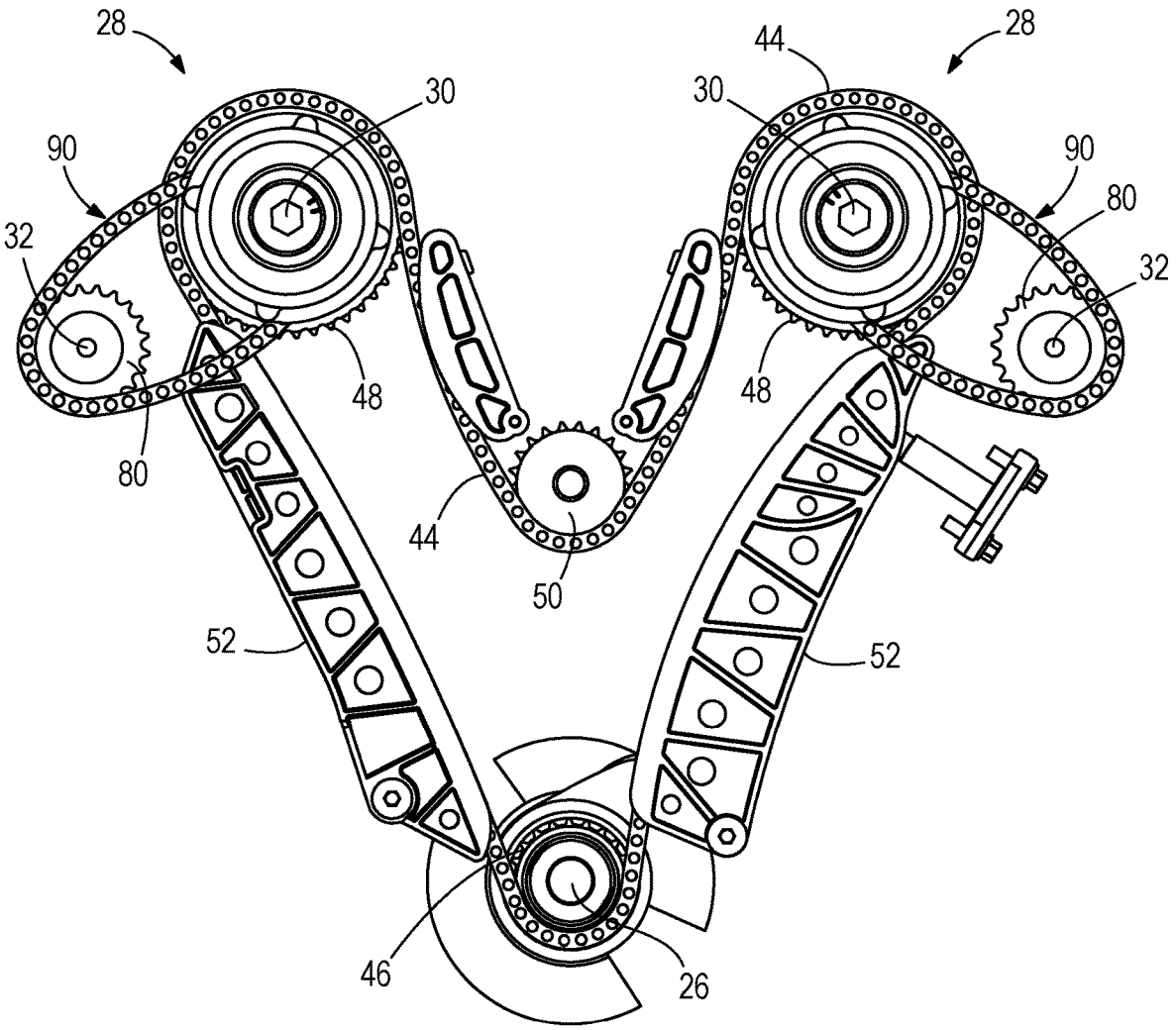
FIG. 2 is an end view of a crankshaft coupled to a pair of dual overhead cam arrangements.
Figure 3:
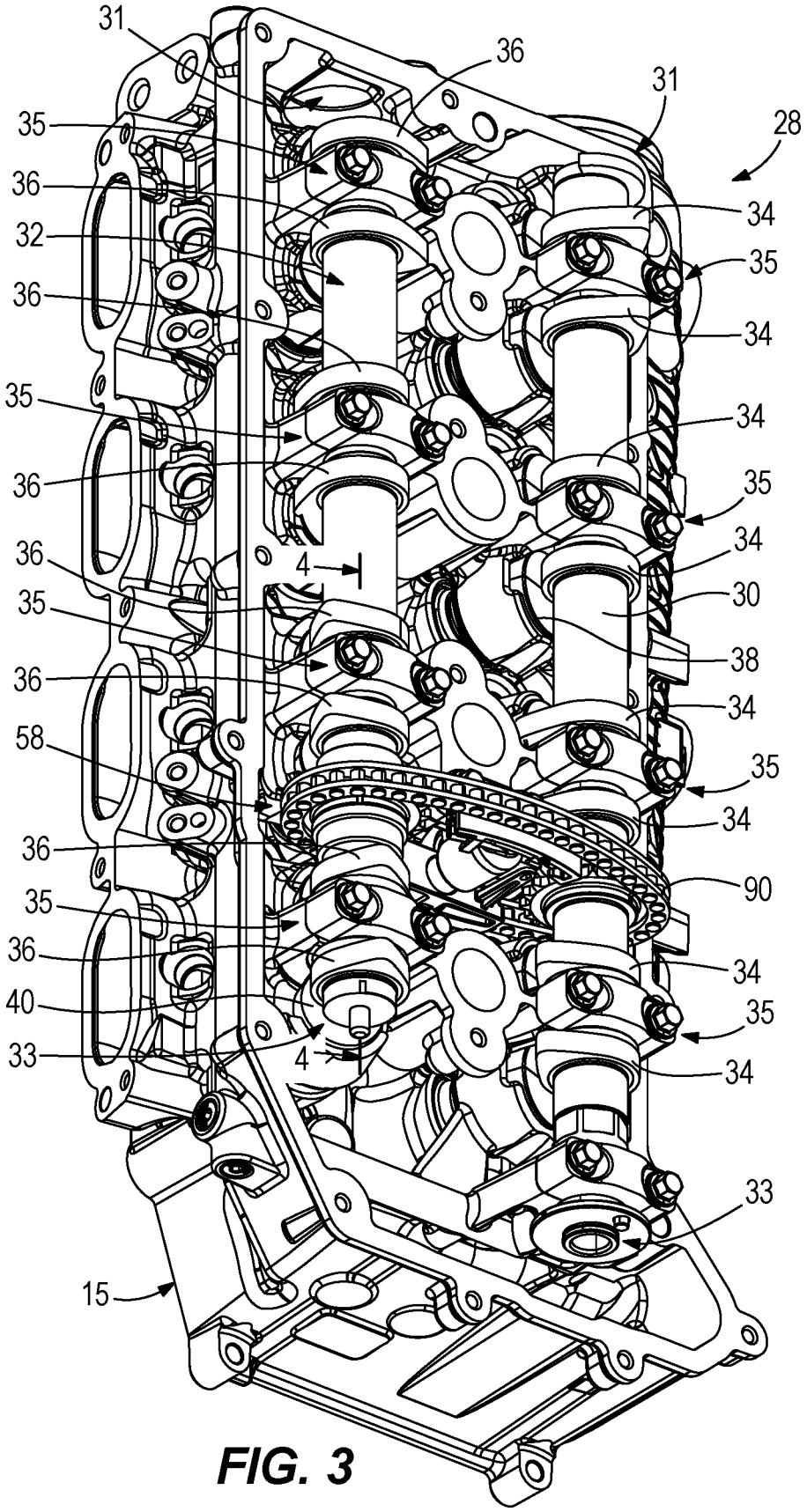
FIG. 3 is a perspective view of an cylinder head containing one of the dual overhead cam arrangements shown in FIG. 2, and having a cam phaser configured according to the present disclosure.

Referring now to FIGS. 2 and 3, the present embodiment of the engine 14 has a pair of dual overhead cam arrangements 28 for controlling supply of intake air to and discharge of exhaust gas from the cylinders. FIG. 2 is an isolated view of the crankshaft 26 and the dual overhead cam arrangements 28. FIG. 3 is a perspective view of the port cylinder head 15 of the engine 14, as well as the associated port-side dual overhead cam arrangement 28. The starboard cylinder head is not shown but the description herein below equally applies.

Each dual overhead cam arrangement 28 has an exhaust camshaft 30 and an intake camshaft 32. The camshafts 30, 32 extend parallel to each other and parallel to the crankshaft 26. In the embodiment shown, the exhaust camshaft 30 would be located closer to the center of the V-shape than the intake camshaft 32. The camshafts 30, 32 have cam lobes 34, 36, respectively, which operate exhaust and intake valves 38, 40, respectively. The valves 38, 40 are conventional and can be configured just like the valves disclosed in the above-incorporated U.S. Pat. No. 9,944,373, among others. The exhaust valves 38 would thus also be located closer to the center of the V-shape than the intake valves 40. However it should be understood that the present disclosure is equally applicable to embodiments wherein the exhaust camshaft and exhaust valves are located further from the center of the V-shape than the intake camshaft and intake valves 40. The camshafts 30, 32 extend between a first (upper) end 31 and an opposite, second (lower) end 33 relative to the outboard motor 12. Several bearings 35 are spaced apart along the camshafts 30, 32 and support rotation of the camshafts 30, 32 relative to the head 15. The cam lobes 34, 36 are adjacent to and on opposite sides of respective bearings 35 thus limiting or preventing axial movement of the respective camshafts 30, 32.

Referring to FIGS. 1-4, the engine 14 causes rotation of the crankshaft 26, which in turn causes rotation of the camshafts 30, 32, which in turn causes rotation of the cam lobes 34, 36, which in turn open the exhaust and intake valves 38, 40, respectively. Continued rotation of the camshafts 30, 32, further rotates the cam lobes 34, 36, which allows springs 42 on the exhaust and intake valves 38, 40 to close the exhaust and intake valves 38, 40, respectively. This opening/closing cycle repeats as the camshafts 30, 32 are continuously rotated during the combustion process, thereby allowing intake air into the noted cylinders, and permitting discharge of exhaust gas from the cylinders. This is conventional and well described, for example, in the presently-incorporated U.S. Pat. No. 9,944,373. Thus it will be understood by those having ordinary skill in the art that each dual overhead cam arrangement 28 is configured such that rotation of the crankshaft 26 facilitates combustion by permitting flow of the intake air to the respective cylinders and also by permitting discharge of the exhaust gas from the respective cylinders.

Referring to FIG. 2, similar to the arrangements disclosed in the presently-incorporated '455 patent, the crankshaft 26 is operatively connected to the exhaust camshafts 30 by a flexible connector, which in this embodiment is a (primary) chain 44. The type of connector can vary from what is shown, and in other embodiments can include a belt and/or the like. The chain 44 is caused to rotate by a drive sprocket 46 located on the crankshaft 26 and engaged with the chain 44. The chain 44 is also engaged with sprockets 48 on the exhaust camshafts 30, such that rotation of the chain 44 causes rotation of the exhaust camshafts 30. An idler sprocket 50 located between the exhaust camshafts 30 is engaged with the chain 44 and is caused to rotate by rotation of the chain 44. The idler sprocket 50 is located and sized so as to maintain tension in the chain 44 and to support rotational movement of the chain 44. Movement of the chain is also supported by conventional chain guides 52.

Now referring to FIGS. 3-6, a novel cam phaser 58 is specially configured to permit selective variation of the timing of operation of the camshafts 30, 32 and respective valves 38, 40, for example depending on the operational condition of the engine 14. The cam phaser 58 is located between the first and second ends 31, 33 of the camshafts 30, 32. Note that this is a different location than what is disclosed in the prior art '455 patent, wherein the cam phaser is positioned at the lowermost end of the camshafts. In the presently illustrated embodiment, the cam phaser 58 is located between the second and third lowermost bearings 35 on the exhaust camshaft 30 and below the second-to-lowermost bearing 35 on the intake camshaft 32. As such, the cam phaser 58 is generally positioned above the lowermost cylinders of the engine 14 and below the second-to-lowermost cylinders. It should however be understood that the illustrated location is not the only embodiment contemplated by the present disclosure. In other embodiments, the cam phaser 58 could be located between any of the other bearings 35 along the camshafts 30, 32, at any location between the first and second ends 31, 33.

Figure 4:
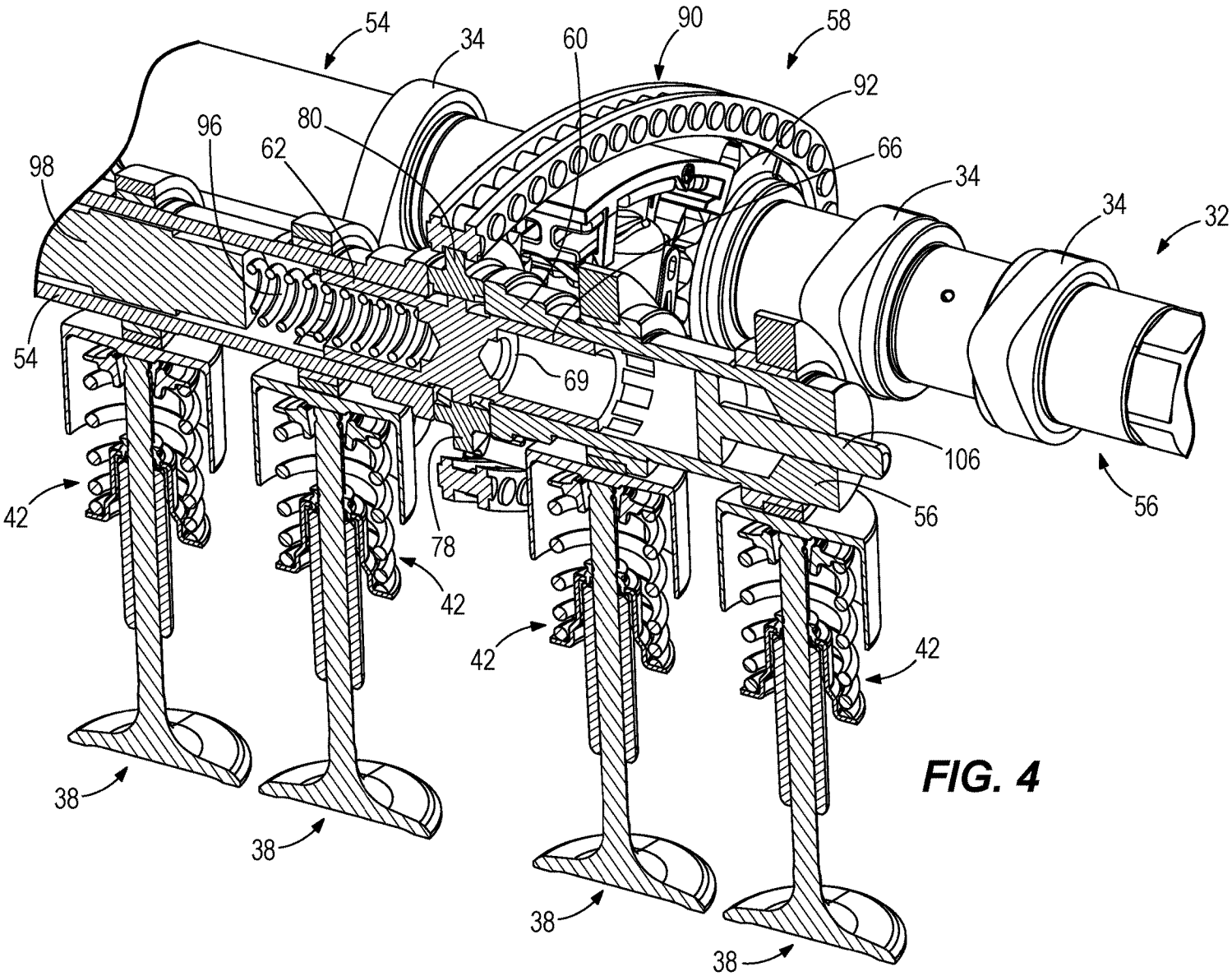
FIG. 4 is a view of section 4-4, taken in FIG. 3.
Figure 5:
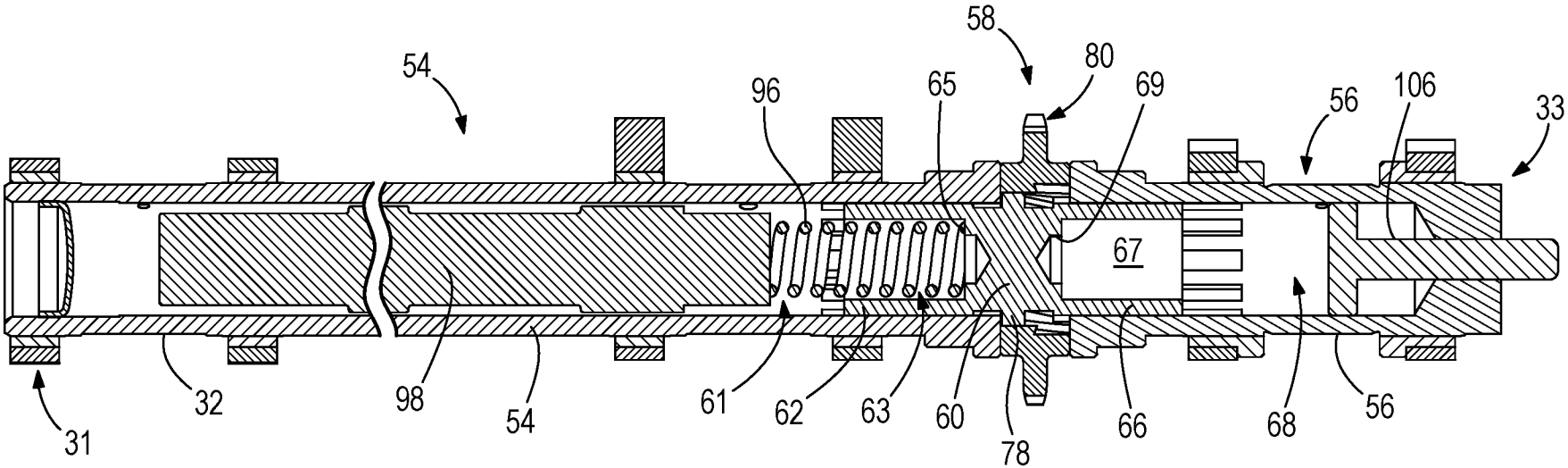
FIG. 5 is a sectional view of the cam phaser installed in an intake camshaft.
Figure 6:
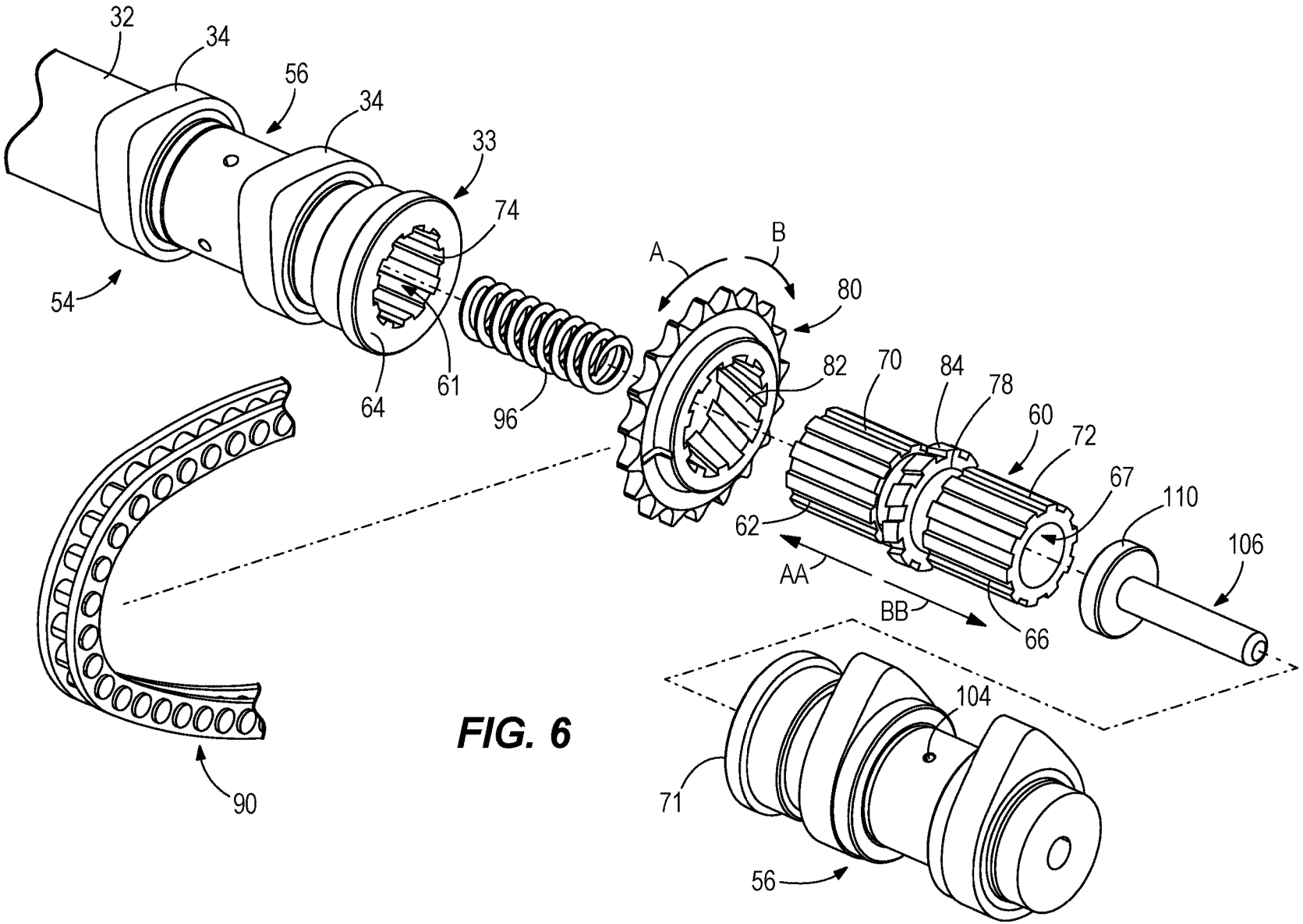
FIG. 6 is an exploded view of the cam phaser and the intake camshaft.

Referring to FIGS. 4-6, the intake camshaft 32 is comprised of a first (upper) camshaft portion 54 and a second (lower) camshaft portion 56. Each camshaft portion is a generally elongated cylindrical member having a hollow or partially hollow interior. In the illustrated embodiment, the first and second camshaft portions 54, 56 are separate components which are separately supported by different bearings 35 and together comprise the exhaust camshaft 30. The first camshaft portion 54 is above the second camshaft portion 56 relative to the position of these components on the outboard motor 12. However in other embodiments the first camshaft portion 54 and second camshaft portion 56 could be physically connected and/or formed as a single, monolithic component having for example a window or other opening therein. In other embodiments, the first camshaft portion 54 and second camshaft portion 56 could be horizontally aligned, or the second camshaft portion 56 could be above the first camshaft portion 54.

Figure 7:
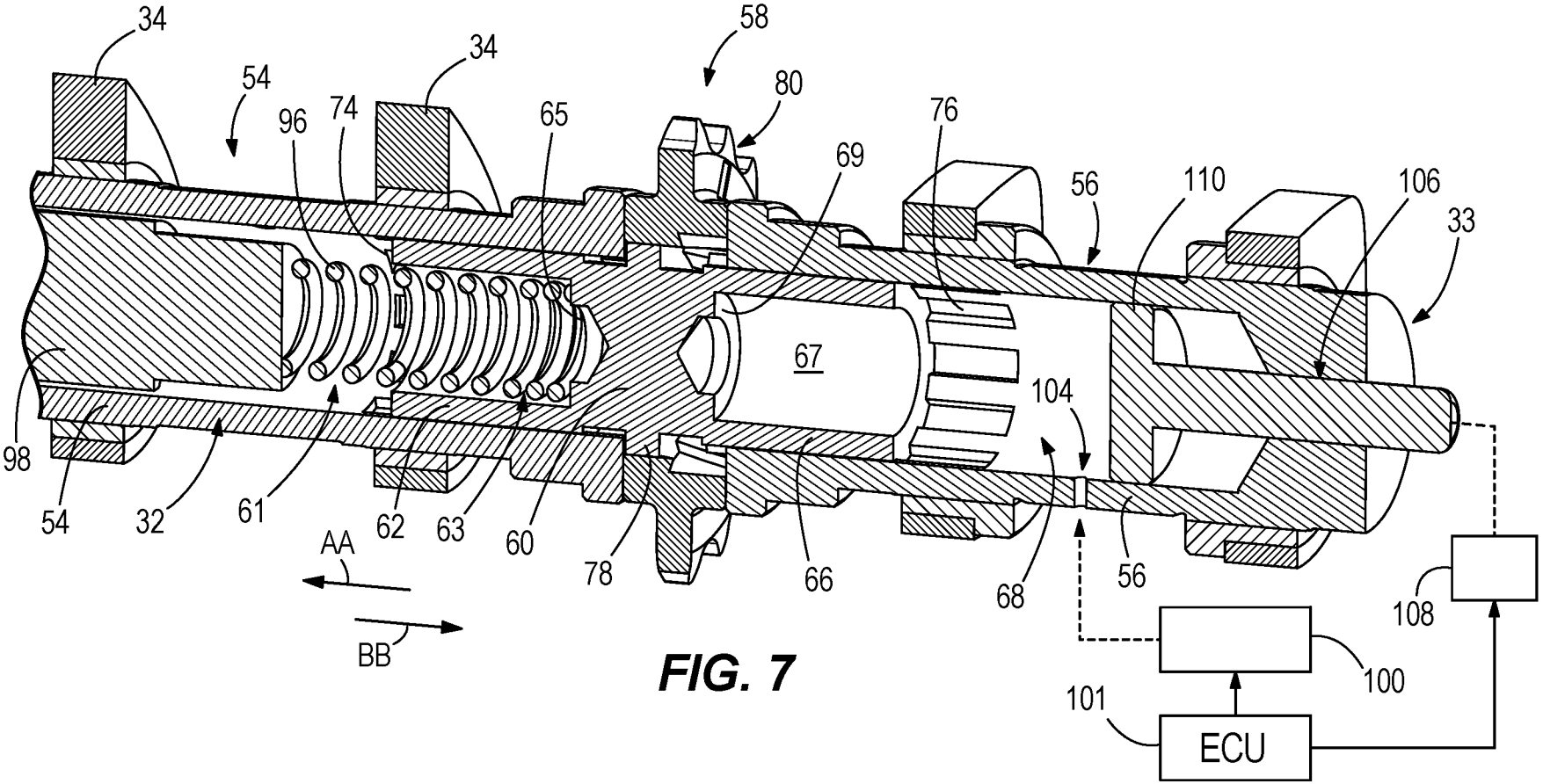
FIG. 7 is a sectional view of the cam phaser in a fully phased position.
Figure 8:
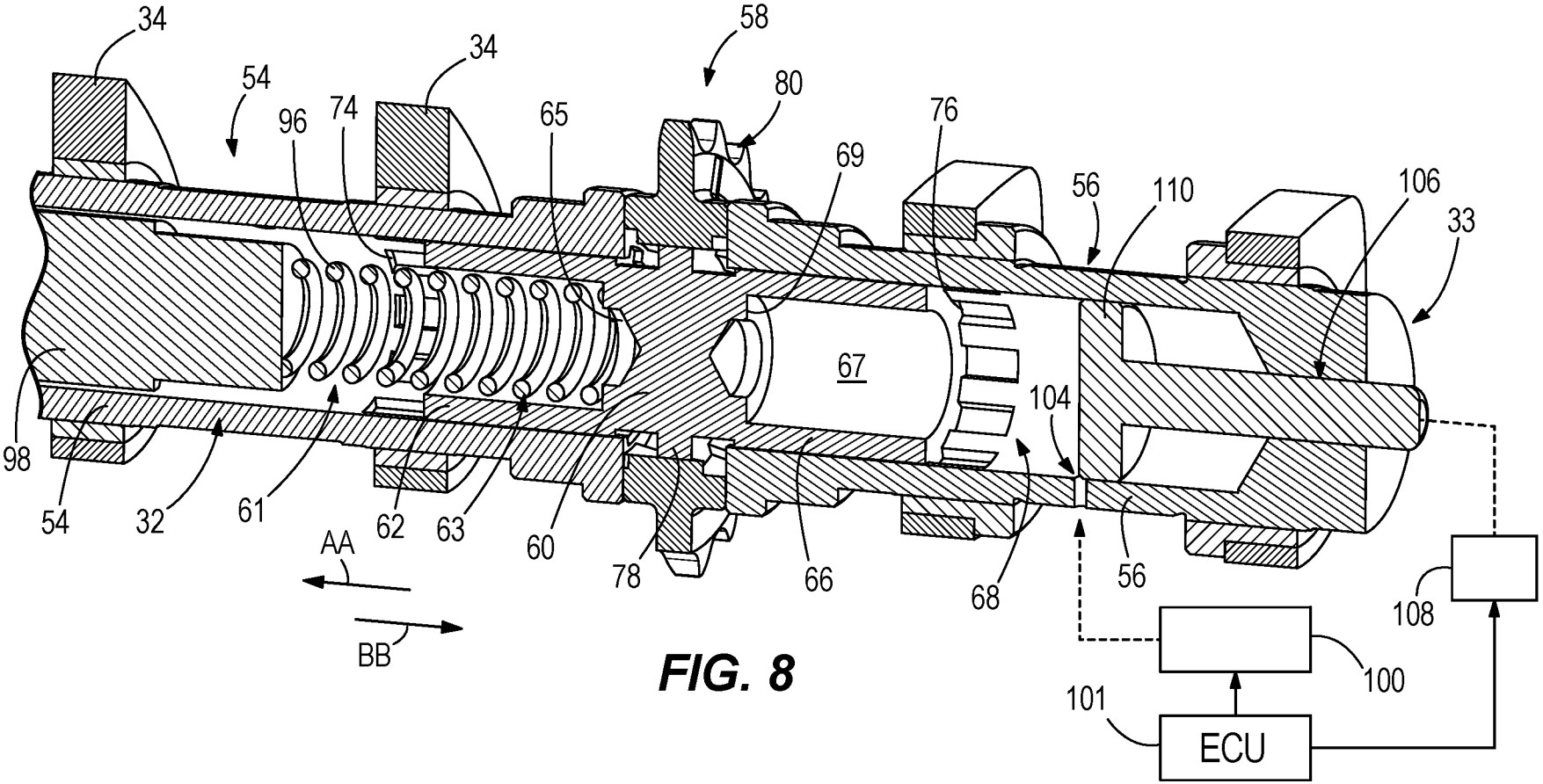
FIG. 8 is a view like FIG. 7, showing the cam phaser in a partially phased position.
Figure 9:
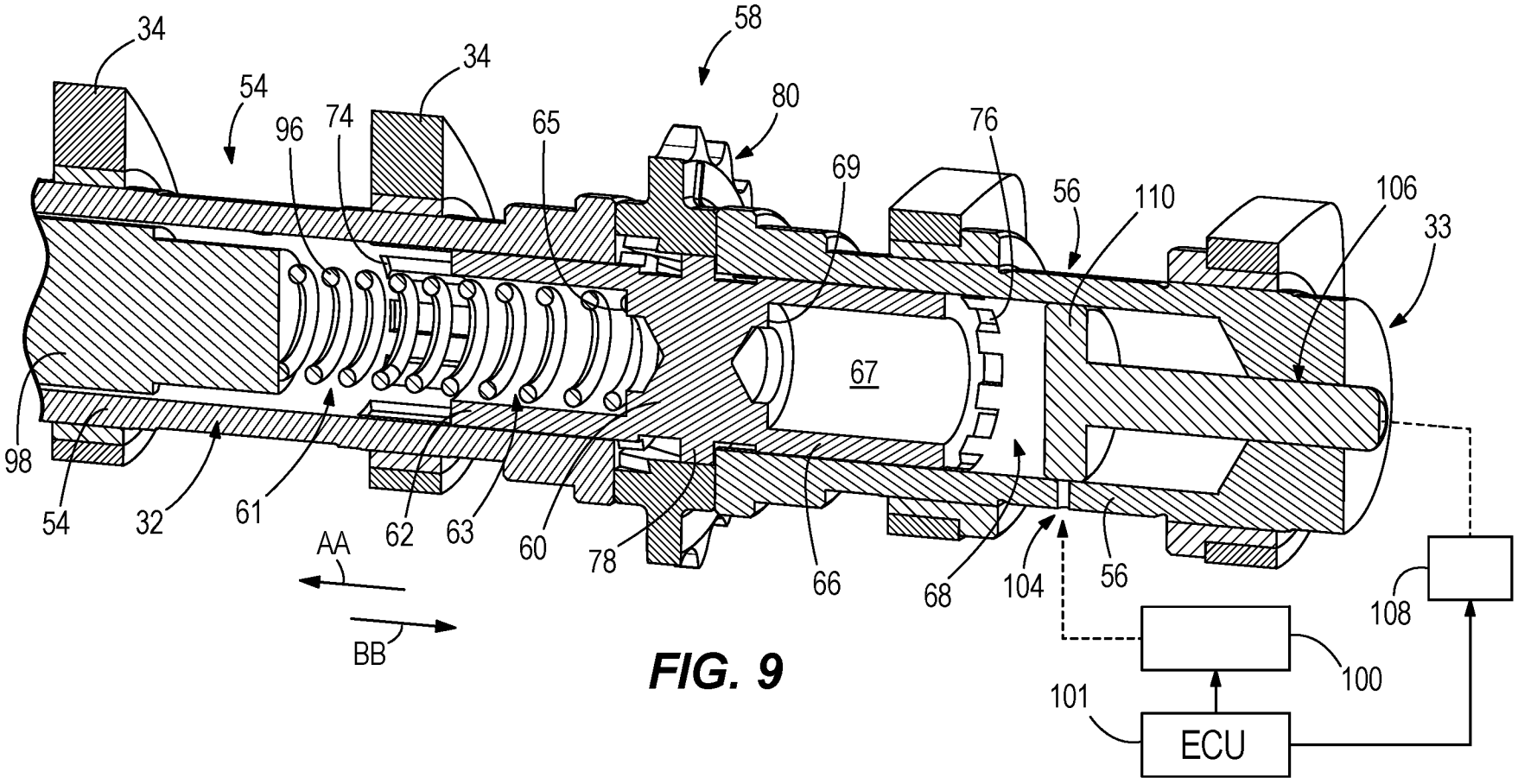
FIG. 9 is a view like FIG. 8, showing the cam phaser in an unphased position.

Referring to FIGS. 4-6, and particularly FIG. 6, the cam phaser 58 has a slider body 60 that is axially slidable back and forth in the intake camshaft 32, as will be further explained herein below. The slider body 60 has a first slider end 62 extending into a hollow interior 61 of the first camshaft portion 54 and a second slider end 66 extending into the hollow interior 68 of the second camshaft portion 56. The first slider end 62 has a hollow interior 63 with an inner end surface 65. The second slider end 66 has a hollow interior 67 with an inner end surface 69. Axial splines 70 on the external surface of the first slider end 62 are engaged with axial splines 74 on the internal surface of the first camshaft portion 54. Axial splines 72 on the external surface of the second slider end 66 are engaged with axial splines 76 on the internal surface of the second camshaft portion 54. Via the noted splined connections to the camshaft 32, the slider body 60 remains rotationally locked with the camshaft 32, such that these components always rotate together during the above-described combustion process. However via the noted splined connections, the slider body 60 is allowed to axially move or slide back and forth relative to the camshaft 32, as shown in FIGS. 7-9 and further described herein below. A raised annular shoulder 78 is located between the first and second slider ends 62, 66 and provides axially opposed end surfaces, i.e., stop surfaces, for engaging the axially inner end surfaces 64, 71 of the first and second camshaft portions 54, 56, and limiting axial (sliding) movement of the first and second slider ends 62, 66 relative to the first and second camshaft portions 54, 56.

Referring to FIG. 6, a rotatable member, which in the illustrated embodiment is a sprocket 80, is disposed on and coupled to the raised shoulder 78, in particular between the first and second slider ends 62, 66. The sprocket 80 has an annular radially inner surface with helical splines 82 which are engaged with a corresponding helical splines 84 on the annular radially outer surface of the annular shoulder 78. Due to the helical splined connection, axial movement (sliding) of the slider body 60 in a first axial direction (arrow AA) causes the sprocket 80 to rotate in a first rotational direction (arrow A) about the raised annular shoulder 78. Conversely, axial movement (sliding) of the slider body 60 in an opposite, second axial direction (arrow BB) causes rotation of the sprocket 80 in an opposite, second rotational direction (arrow B).

A flexible coupler, which in the illustrated embodiment is a (secondary) chain 90, is wrapped around and coupled to the noted sprocket 80 on the intake camshaft 32. The chain 90 is also wrapped around and coupled to a sprocket 92 (see FIG. 4) which is fixed to the intake camshaft 32 at the above-described location, i.e., between the ends 31, 33 of the camshafts 30, 32. More specifically, the chain 90 is located on the exhaust camshaft 30 between the second and third lowermost bearings 35. The chain 90 is located on the intake camshaft 32 below the second-to-lowermost bearing 35. As such, the chain 90 is generally positioned above the lowermost cylinders of the engine 14 and below the second-to-lowermost cylinders. The location of the chain 90 can vary from what is shown and described. Also the type and configuration of the rotatable member and flexible coupler can vary from what is shown and for example could include a belt-drive configuration or a direct mechanical linkage-drive configuration instead of or in addition to the depicted chain-drive configuration. Referring to FIG. 2, it can be seen that the chain 90 rotationally couples the exhaust camshaft 30 to the intake camshafts 32 such that rotation of the exhaust camshaft 30 causes rotation of the respective intake camshaft 32. Advantageously, the relative timing or rotational positioning of these rotations can be actively varied by the cam phaser 58, as will be further described herein below.

Figure 10:
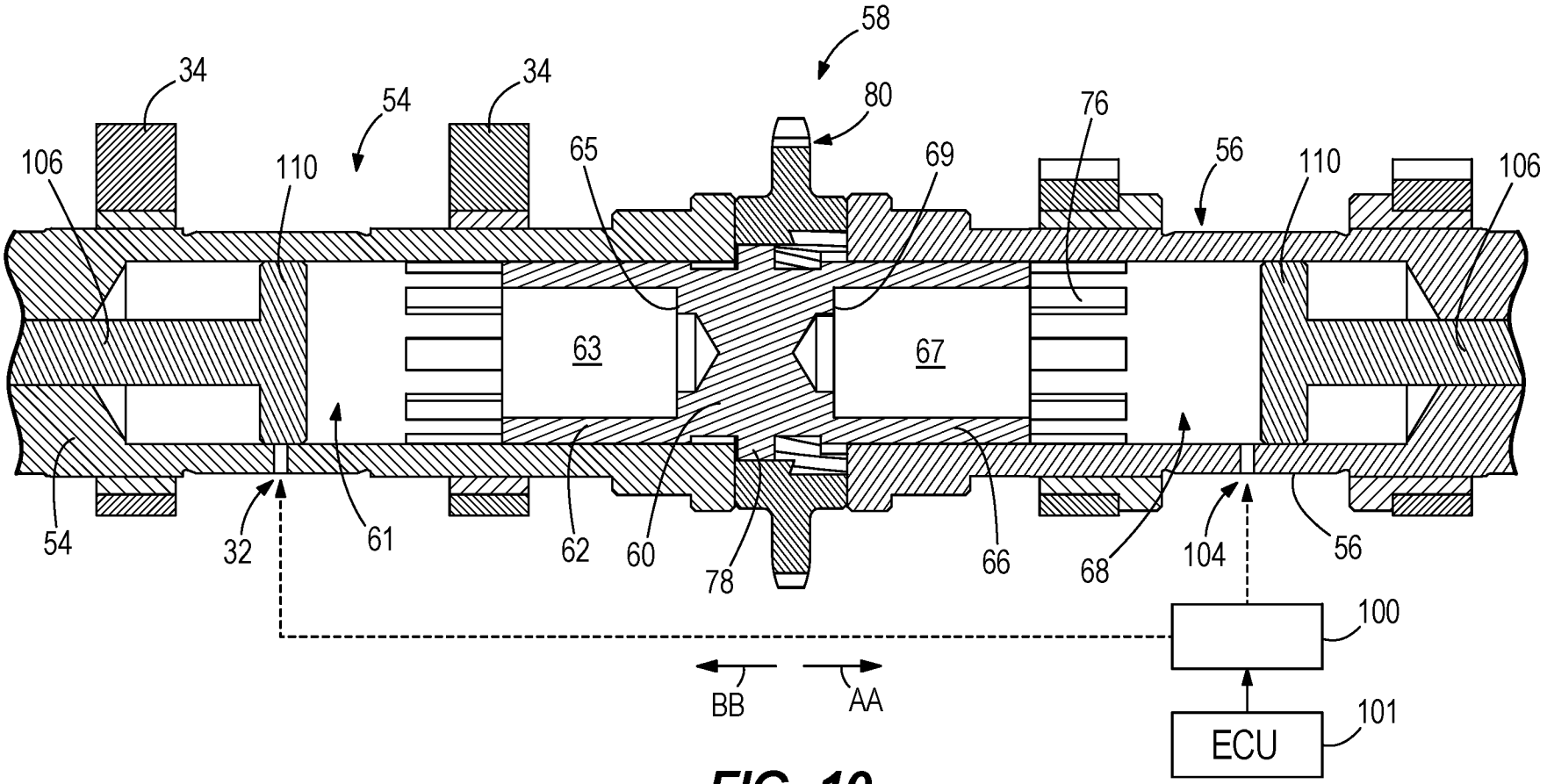
FIG. 10 is a sectional view of another embodiment of the cam phaser in a fully phased position.

An actuator is provided for axially moving (slide) the slider body 60 relative to the intake camshaft 32 in a controlled manner. The type and configuration of the actuator can widely vary from what is shown and described. FIGS. 4-9 depict a first embodiment of the actuator, and FIG. 10 depicts a second embodiment of the actuator. Alternate actuator embodiments are certainly possible as will be apparent from the description herein below.

In the non-limiting embodiment of FIGS. 4-9, a return spring 96 has a first end located in the first camshaft portion 54 and an opposite, second end located in the hollow interior 63 of the first slider end 62. The first end of the return spring 96 abuts a rigid perch member 98 located in the hollow interior 63. The second end of the return spring 96 abuts the inner end surface 65 of the hollow interior 63. Referring to FIGS. 6 and 7, the return spring 96 has a natural spring bias towards an extended position, which axially pushes or slides the slider body 60 in the direction of arrow BB, towards the "unphased" position shown, in which the end surface of the raised shoulder 78 abuts the end 71 of the second camshaft portion 56. As discussed above, movement of the slider body 60 in the direction of arrow BB rotates the sprocket 80 in the direction of arrow B.

A conventional hydraulic pump and associated pump control mechanism 100 is configured to supply pressurized hydraulic fluid to the hollow interior 68 of the second camshaft portion 56 via an inlet port 104 formed through the second camshaft portion 56. The type and configuration of the pump and control mechanism 100 can vary. In exemplary embodiments, the pump is a conventional engine lubrication pump and control mechanism associated with many current commercially available outboard motors produced by Mercury Marine. Such lubrication pumps and control mechanisms for marine engines are well-known by those having ordinary skill in the art and thus are not further herein described. The control mechanism for the pump can be configured just like the control mechanisms in known cam phasers having vanes, which are currently commercially available, and are described in the above-incorporated U.S. patents. See especially the '455 patent. An engine control unit 101 having a processor and memory is provided for controlling operation of the pump 100.

A piston 106 is movable (slideable/reciprocable) back and forth inside the hollow interior 68 of the camshaft portion 56 by a piston actuator, which for example is a conventional bidirectional electric motor 108 which is controlled by the engine control unit 101. The piston 106 has an annular head 110 that abuts the annular interior surface of the hollow interior 68. The motor 108 is mechanically coupled to the piston 106 by for example a not-shown worm gear, angle gears, and/or the like, and is operable in a first direction to move the piston 106 into the position for example shown in FIG. 7, wherein the port 104 is uncovered and hydraulic fluid is supplied to the hollow interior 68 by the pump 100, and in an opposite, second direction to move the piston 106 into the position for example shown in FIG. 8, wherein the port 104 is partially covered by the piston 106, and further into the position for example shown in FIG. 9, wherein the port 104 is completely covered. Accordingly via operation of the engine control unit 101 and motor 108, the position of the piston 106 relative to the port 104 can be actively changed, which thereby controls the position of the slider body 60, and thereby actively controls the supply of pressurized hydraulic fluid to the chamber 68.

In the position shown in FIG. 7, the port 104 is fully uncovered by the piston 106 and thus a relatively high force of pressure of the hydraulic fluid presses against the inner end surface 69 of the second slider end 66, which compresses the return spring 96 and moves (slides) the slider body 60 in the direction of arrow AA, into the fully phased position shown, wherein the spring 96 is compressed and the end surface of the raised shoulder 78 abuts the end 64 of the first camshaft portion 54. Movement of the slider body 60 in the directions of arrow AA rotates the sprocket 80 in the direction of arrow A via the helical splined coupling, which in turn phases the rotational position of the intake camshaft 32 relative to the exhaust camshaft 30, and thus controls of the timing of opening/closing of the intake and exhaust valves 38, 40.

In the position shown in FIG. 8, the port 104 is partially uncovered by the piston 106 and thus a relatively lower amount of force of pressure of the hydraulic fluid presses against the inner end surface 69 of the second slider end 66, which only partially compresses the return spring 96 and permits the slider body 60 to move (slide) in the direction of arrows B-B to the partially phased position shown. Movement of the slider body 60 in the direction of arrows B-B rotates the sprocket in the direction of arrow B, via the helical splined coupling, which in turn phases the rotational position of the intake camshaft 32 relative to the exhaust camshaft 30, and thus controls the timing of the opening/closing of the intake and exhaust valves 38, 40.

In the position shown in FIG. 9, the port is entirely covered by the piston 106, preventing supply of hydraulic fluid to the chamber 68. The splined coupling is configured to constantly permit a relatively small amount of leakage of the hydraulic fluid from the chamber 68, which reduces the pressure in the chamber 69 and permits the return spring 96 to further move (slide) the slider body 60 in the direction of arrow BB into the unphased position shown. Further movement of the slider body 60 in the direction of arrows B-B further rotates the sprocket in the direction of arrow B, via the helical splined coupling, which in turn phases the rotational position of the intake camshaft 32 relative to the exhaust camshaft 30, and thus controls the timing of the opening/closing of the intake and exhaust valves 38, 40.

It will thus be understood by one having ordinary skill in the art that the actuator configuration shown in FIGS. 7-9 facilitates precise control of the cam phaser 58, for adjustment of phasing during various operational states of the engine 14, for example based on engine speed, engine load, and other conditions. In some embodiments, the actuator is configured to provide only maximum and minimum pressure, which permits only the extreme positions shown in FIGS. 7 and 9. In other embodiments, the hydraulic pump 100 is configured to provide more precise control of the hydraulic fluid, for example via pulse width modulated (PWM) control, thus enabling finite positional control of the position of the cam phaser 58 in the positions shown in FIGS. 7, 8 and 9, as well as any position there between. The hydraulic fluid in the chamber 68 is permitted to leak past the splined connection between the slider body 60 and the camshaft portions 54, 56, thus facilitating extension of the return spring 96 when the pressure in the chamber 68 is reduced due to movement of the piston 106. Also, when the engine 14 is off and thus the pump and control mechanism 100 stops providing lubrication, leakage of lubrication past the splined connection permits the return spring 96 to move the slider body 60 into the position shown in FIG. 9.

FIG. 10 depicts an alternate embodiment of the actuator, which omits the return spring. In this embodiment, the hydraulic pump 100 supplies hydraulic fluid to both sides of the slider body 60. The slider body 60 is caused to move in either direction AA and BB into and between fully phased and unphased positions in a controlled manner based on the difference in pressure on opposite sides of the slider body 60, i.e., the difference of pressure in the chambers 61, 68, as controlled by the hydraulic pump and control mechanism 100. Although not shown, the embodiment of FIG. 10 can also include one or more bidirectional electric motors 108 for operating opposing pistons 106, which are controlled by the ECU 101 similar to how these features are configured according to the embodiment in FIGS. 4-9. In other embodiments, a conventional Variable Cam Timing Solenoid can be included in place of the piston(s) 106 can externally control the position of the slider body 60. Such Variable Cam Timing Solenoids are well known in the art and commercially available.

As such, the present disclosure provides a novel cam phaser that is located at least partially inside at least one of the intake camshaft and the exhaust camshaft and is configured to vary a timing of operation of at least one of the intake valves and exhaust valves. The embodiments described herein above advantageously take up less valuable space within the powerhead compartment and also facilitate phasing of one of the camshafts (e.g., the intake camshaft) relative to the other of the camshafts (the exhaust camshafts). It should be recognized that the novel cam phaser is not limited for integration with the intake camshaft and in other embodiments could instead or also be integrated with the exhaust camshaft.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses embodiments to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other embodiments that occur to those skilled in the art. Such other embodiments are intended to be within the scope of the claims if they have features or structural elements that do not differ from the literal language of the claims, or if they include equivalent features or structural elements with insubstantial differences from the literal languages of the claims.

What is claimed is:

1. A marine engine comprising:

a crankshaft; and at least one dual overhead cam (DOHC) assembly including:

a first camshaft rotationally coupled to the crankshaft;

a second camshaft rotationally coupled to the first camshaft;

a plurality of cylinders; and a cam phaser located at least partially inside the first camshaft, the cam phaser comprising a rotatable member arranged along the first camshaft at a position between adjacent cylinders of the plurality of cylinders, wherein the second camshaft is rotationally coupled to the first camshaft via the rotatable member such that the cam phaser is configured to vary a timing of operation of the second camshaft with respect to the first camshaft, wherein the first camshaft is one of an intake camshaft and an exhaust camshaft, and wherein the second camshaft is a remaining one of the intake camshaft and the exhaust camshaft.

2. The marine engine according to claim 1, wherein the cam phaser further comprises a slider body configured to slide axially within the first camshaft.

3. The marine engine according to claim 2, wherein the slider body is located in a hollow interior of the first camshaft.

4. The marine engine according to claim 3, wherein the slider body is rotationally coupled to the first camshaft via axial splines.

5. The marine engine according to claim 3, further comprising an actuator configured to selectively apply pressurized hydraulic fluid on the slider body so as to move the slider body from an unphased position to a phased position.

6. The marine engine according to claim 5, wherein the cam phaser further comprises a return spring that biases the slider body into the unphased position.

7. The marine engine according to claim 2, wherein axial movement of the slider body causes rotation of the rotatable member with respect to the slider body.

8. The marine engine according to claim 7, wherein the rotatable member rotates with respect to the slider body via helical splines.

9. The marine engine according to claim 7, wherein the cam phaser further comprises a coupler that rotationally couples the second camshaft to the rotatable member such that the axial movement of the slider body further causes rotation of the coupler so as to vary said timing.

10. The marine engine according to claim 9, wherein the rotatable member comprises a sprocket, and wherein the coupler comprises a chain.

11. The marine engine according to claim 9, wherein the first camshaft comprises a first camshaft portion and an opposite, second camshaft portion, and wherein the rotatable member is located axially between the first camshaft portion and second camshaft portion.

12. The marine engine according to claim 11, wherein the first camshaft portion and the second camshaft portion are separate components that together define the first camshaft.

13. The marine engine according to claim 12, wherein the slider body comprises a first slider end that extends into the first camshaft portion, and a second slider end that extends into the second camshaft portion.

14. The marine engine according to claim 13, wherein the rotatable member is coupled to the slider body between the first slider end and the second slider end.

15. The marine engine according to claim 9, wherein the slider body is located in a hollow interior of the first camshaft, and wherein an actuator of the marine engine is configured to selectively apply pressurized hydraulic fluid on the slider body so as to move the slider body from an unphased position to a phased position.

16. A marine engine comprising:

a crankshaft; and at least one dual overhead cam (DOHC) assembly including:

a first camshaft rotationally coupled to the crankshaft;

a second camshaft rotationally coupled to the first camshaft;

plurality of cylinders; and a cam phaser configured to vary a timing of operation of the second camshaft with respect to the first camshaft, wherein the first camshaft is formed as an assembly including a first camshaft portion and a separate second camshaft portion, wherein the second camshaft is rotationally coupled to the first camshaft via a rotatable member of the cam phaser, wherein the rotatable member is located along the first camshaft at a position axially between the first camshaft portion and the second camshaft portion, wherein the first camshaft is one of an intake camshaft and an exhaust camshaft, and wherein the second camshaft is a remaining one of the intake camshaft and the exhaust camshaft.

17. The marine engine according to claim 16, wherein the cam phaser further comprises a slider body configured to slide axially within the first camshaft.

18. The marine engine according to claim 17, wherein the cam phaser further comprises a coupler that rotationally couples the second camshaft to the rotatable member such that axial movement of the slider body causes rotation of the rotatable member and the coupler with respect to the slider body so as to vary said timing.

* * * * *